United States Patent [19]

Haage

[11] 3,984,270

[45] Oct. 5, 1976

[54] PROCESS FOR ROOF CONSTRUCTION

[75] Inventor: Karl Haage, Troisdorf-Spich, Germany

[73] Assignee: Dynamit Nobel Aktiengesellschaft, Germany

[22] Filed: Apr. 30, 1975

[21] Appl. No.: 572,885

[30] Foreign Application Priority Data

May 2, 1974 Germany ..... 2421154

[52] U.S. Cl. ..... 156/71; 52/304; 156/82; 156/304; 156/322; 156/333

[51] Int. Cl.[2] ..... E04B 7/00

[58] Field of Search ..... 156/71, 304, 78, 79, 156/82, 333, 322; 220/9 F, 9 LG; 52/304

[56] References Cited

UNITED STATES PATENTS

| | | | |
|---|---|---|---|
| 3,251,912 | 5/1966 | Fish | 156/79 |
| 3,325,037 | 6/1967 | Kohn et al. | 220/9 LG |
| 3,661,669 | 5/1972 | Cairns | 156/304 |
| 3,697,633 | 10/1972 | Edgar | 156/79 |
| 3,895,146 | 7/1975 | Nishimaki et al. | 220/9 LG |

*Primary Examiner*—Edward G. Whitby
*Attorney, Agent, or Firm*—Craig & Antonelli

[57] ABSTRACT

A process for manufacturing a heat-insulating roof construction is provided by laying a layer of heat-insulating panels on a roof substructure and overlying sealing sheets of synthetic resin material on the heat-insulating panels. Fillets or narrow strips of foam material are inserted between butt edges of adjoining heat-insulating panels for joining the panels to the substructure and joining the sealing sheets to the panels.

24 Claims, 1 Drawing Figure

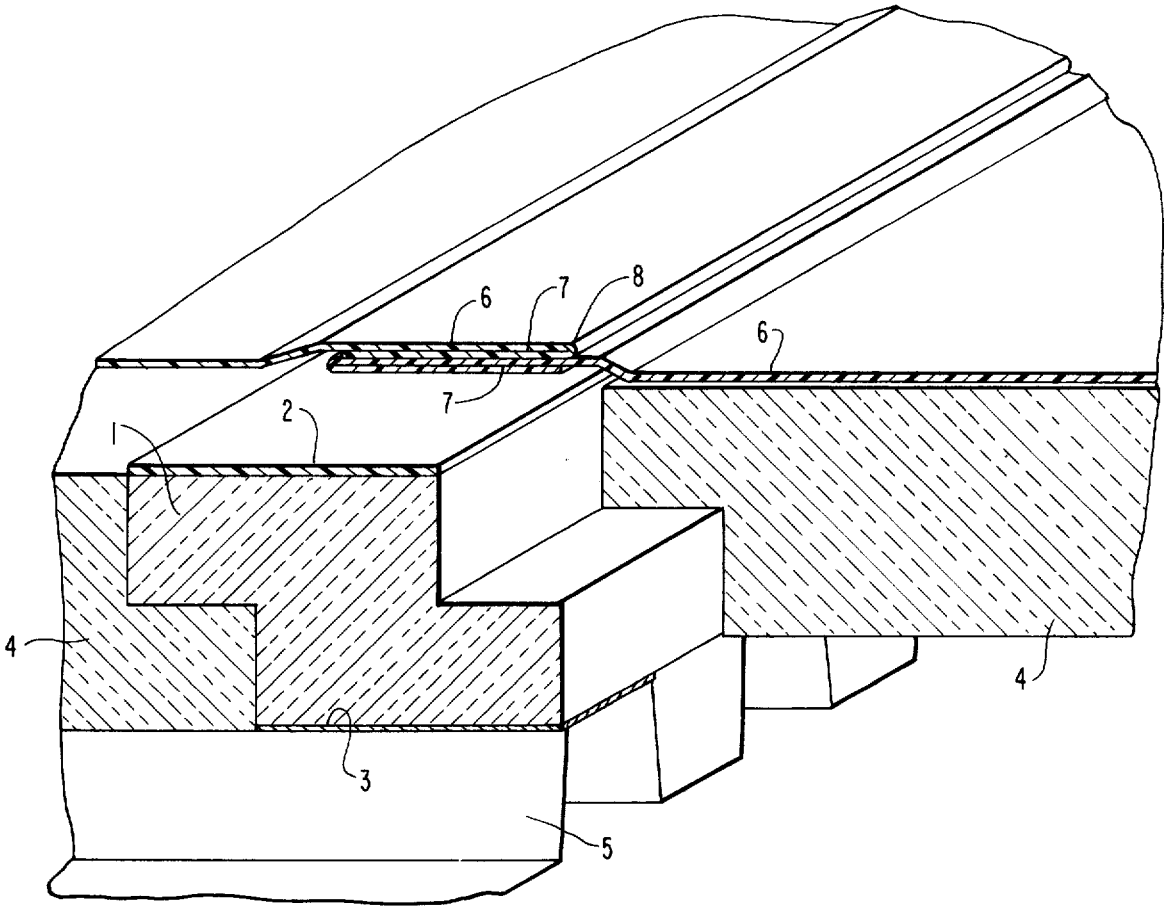
6
7
8
6
7
2
1
4
4
3
5

PROCESS FOR ROOF CONSTRUCTION

The present invention relates to a process for manufacturing a roof structure of the type having a sealing sheet loosely laid over a heat-insulating layer on flat or slightly inclined heat-insulated roofs. The process of the present invention preferably contemplates the use of narrow strips or fillets of foam material for attaching the sealing sheet, together with the heat-insulating layer, to the load-bearing roof structure.

Conventional roof constructions have been provided with and without a gravel load-surface as a covering for flat or slightly inclined roofs. The gravel load-bearing layer serves essentially for anchoring the roofing skin with respect to wind suction. Other roof constructions have been contemplated in the case of unweighted roofs without the gravel load-bearing layer in which heat-insulating panels, together with loosely laid roof sealing sheets overlying the heat-insulating panels, are mounted to a substructure of wood planks, sheet-metal profiles or synthetic resin profiles by means of screws or expandable rivets. These mounting devices are provided along strip-like or spot-like mounting points.

The disadvantages of such conventional mounting methods occur from the penetration of the roof structure by the screws, rivets, nails, or the like. In this regard, metallic joining elements have the effect of so-called cold-conducting bridges, thereby enabling heat losses through the roof structure. Therefore, it is extremely desirable to avoid the problems of the aforementioned disadvantages.

The process of the present invention provides that, during the laying of the heat-insulating panels of the roof construction, fillets or narrowed strips of foam material are inserted in the butt joints present between the adjoining heat-insulating panels. These strips may also be of a foam material, preferably partially cross-linked polyethylene, which also provides heat insulation. Furthermore, these strips are utilized to join the heat-insulating panels to the roof substructure, as well as to join, or mount, to the roof construction the overlying sealing sheets which are laid loosely over the heat-insulating panel layer. In this regard, the fillets may be welded to the roof substructure, as well as to the sealing sheets, particularly by means of a weldable synthetic resin layer such as soft PVC.

The fillet of foam material utilized for effecting the present invention is advantageously constructed such that the overlying sealing sheet of synthetic resin material is firmly joined to the top surface of the foam fillet by means of a carrier material such as cardboard, fabric, sheet-metal strips, or the like by appropriate welding. Furthermore, the foam fillet is constructed with a profiled cross-section which preferably corresponds to the contour of the butt ends of the heat-insulating panels. In this regard, the foam fillets can have a rectangular cross-sectional configuration, or in the case of stepped-shape heat-insulating panels, have a profiled cross-section, for example, being a Z-shape. In this manner, the Z-shaped fillet overlaps one end of an adjoining heat-insulating panel, and underlaps another end of a second heat-insulating panel, such that a smooth layer configuration is provided.

The foam fillet may be formed of any suitable material, preferably a weldable synthetic resin foam. In this regard, especially, partially cross-linked polyethylene foam, which has the properties of partial surface melting upon heating by hot air or an open flame, is advantageous in this roof construction. This partially molten layer makes it possible to bond the fillet positively with the materials of the roof construction, such as, for example, wood, concrete, or metal.

Accordingly, the process of the present invention contemplates joining a heat-insulating roof layer to the roof substructure by means of a transitional heat insulating member at the level of the heat-insulating layer, and further, joining the sealing sheet loosely overlying the heat-insulating layer to the roof structure by means of this transitional member, such that wind suction forces are absorbed by the roof structure and the lifting off of the roof covering is prevented.

Moreover, the present process contemplates welding of the transitional member of a foam fillet by means of a weldable synthetic resin layer, such as soft PVC, to the sealing sheets, which may be made of soft PVC film panels. Such synthetic resin welding is known as solution welding and positively bonds the synthetic resin layer of the sealing sheet to the foam fillet. Thus, a positive force transfer to the roof structure is ensured.

The features of the present invention may be further understood by reference to the drawing FIGURE, which shows by way of example a partial cross-sectional view of the roof structure manufactured by the present process.

The drawing FIGURE shows a fragmentary cross-section of an ungraveled heat-insulated roof covered with synthetic resin sheets 6 to provide sealing of the roof structure. In this structure, a strip or fillet 1 of partially cross-linked polyethylene foam, having approximately a Z-shaped cross-section is inserted at the butt ends of heat-insulating panels 4. Thus, the fillets 1 are provided at the joints of adjacent panels 4. In this construction, the fillet 1 is welded at its underside to a metal sheet roof substructure 5, and may be provided with a soft PVC film 2 laminated thereon. The roof substructure 5 is a metal sheet trapezoidally angled in series with the fillet being hot-welded thereto at the positions 3.

The heat-insulating panels 4 are formed with steps at the side edges thereof to constitute overlying and underlying sections with the Z-shaped fillet 1. These heat-insulating panels 4 are provided of suitable commercially available insulating materials, and may also be a cross-linked foam material.

The roof structure manufactured by the present invention preferably utilizes soft PVC roof sealing sheets 6 overlying the heat-insulating panel layer with the interspersed fillets 1 holding the heat-insulating panels to the substructure 5. These sealing sheets 6, therefore, may be solution-welded at the overlapping joints 7 to the soft PVC film 2 on the top surfaces of the fillets 1. In this regard, the solution welding of the sealing sheets 6 to the fillets 1 is fixed by means of a PVC solution 8.

The following examples are provided for the process of the present invention for constructing a roof structure utilizing the fillets 1.

EXAMPLE I

A layer of heat-insulating foam panels are laid over a roof substructure of a trapezoidal metal sheet. Fillets of foam material made of partially cross-linked polyethylene are inserted between the adjoining edges of the foam panels, and the undersides of these foam fillets are hot-welded to the metal subsurface. Sealing sheets of soft PVC synthetic resins are loosely laid over the roof panels with overlapping joints at the top surfaces of the foam fillets. These overlapping surfaces are welded together and to the top surface of the foam fillet by means of a weldable synthetic resin layer of soft PVC by solution-welding.

EXAMPLE 2

A carrier material, such as cardboard, fabric, sheet-metal strips, or the like, is provided on the top surface of the foam fillet to which the synthetic resin layer is bonded by means of welding. This carrier material effects a firm bonding to the top surface of the foam fillet. The remaining description of the process corresponds to Example 1.

EXAMPLE 3

The foam fillet is profiled with a Z-shaped cross-section. This profiled cross-section mates with step-shaped end surfaces of the heat-insulating foam panels such that overlapping, interlocking layers of the foam fillets with the heat-insulating form panels are provided. The remaining description of the process corresponds to either Example 1 or Example 2.

While I have shown and described several embodiments in accordance with the present invention, it is understood that the same is not limited thereto but is susceptible of numerous changes and modifications as known to a person skilled in the art, and I therefore do not wish to be limited to the details shown and described herein but intend to cover all such changes and modifications as are obvious to one of ordinary skill in the art.

I claim:

1. A process for manufacturing a roof construction comprising laying a plurality of heat-insulating panels over a roof substructure, inserting fillets of partially cross-linked polyethylene foam material between the butt joints of adjoining ones of said plurality of heat-insulating panels, securing said fillets to said roof substructure by heat welding each of said fillets to said roof substructure, overlying sealing sheets on said plurality of heat-insulating panels and said fillets, and securing said sealing sheets to said fillets.

2. A process according to claim 1, wherein said sealing sheets are formed of a synthetic resin material, and said step of securing said sealing sheets to said fillets includes solution welding.

3. A process according to claim 2, wherein said sealing sheets are formed of soft PVC, and wherein said fillets include a layer of synthetic resin on the top surfaces of said fillets.

4. A process according to claim 3, wherein said layer of synthetic resin is soft PVC.

5. A process according to claim 3, wherein said layer of synthetic resin is firmly bonded to said top surfaces of said fillets with a carrier material welded to said fillets.

6. A process according to claim 5, wherein said carrier material includes one of cardboard, fabric, and sheet-metal strips.

7. A process according to claim 6, wherein said fillets are formed with one of a rectangular or a Z-shaped cross-section.

8. A process according to claim 7, wherein the adjoining edges of said plurality of heat-insulating panels are formed step-shaped, and said fillets have a Z-shaped cross-section interlocking with said step-shaped edges.

9. A process according to claim 1, wherein said sealing sheets are formed of soft PVC, and wherein said fillets include a layer of synthetic resin on the top surfaces of said fillets.

10. A process according to claim 9, wherein said layer of synthetic resin is soft PVC.

11. A process according to claim 1, wherein said fillets are formed with one of a rectangular or a Z-shaped cross-section.

12. A process according to claim 11, wherein the adjoining edges of said plurality of heat-insulating panels are formed step-shaped, and said fillets have a Z-shaped cross-section interlocking with said step-shaped edges.

13. A process according to claim 1, wherein said step of heat welding is carried out by applying one of hot air or an open flame to a surface of each of said fillets in contact with said roof substructure such that partial melting of said surface is effected to bond said surface to said roof substructure.

14. A process according to claim 4, wherein said step of solution welding is carried out by applying a PVC solution between said PVC sealing sheets and said PVC layer on the top surfaces of said fillets.

15. A process according to claim 10, wherein said step of solution welding is carried out by applying a PVC solution between said PVC sealing sheets and said PVC layer on the top surfaces of said fillets.

16. A process for manufacturing a roof construction comprising laying a plurality of preformed heat-insulating panels over a roof substructure;

joining said plurality of heat-insulating panels to said roof substructure by inserting fillets of foam material between the butt joints of adjoining ones of said plurality of heat-insulating panels, and securing said fillets to said roof substructure;

overlying sealing sheets on said plurality of heat-insulating panels and said fillets; and joining said sealing sheets to a composite roof construction of said plurality of heat-insulating panels joined to said roof substructure by said fillets by securing said sealing sheets to said fillets.

17. A process according to claim 16, wherein said fillets are formed of partially cross-linked polyethylene, and said step of securing said fillets to said roof substructure includes heat welding.

18. A process according to claim 17, wherein said step of heat welding is carried out by applying one of hot air or an open flame to a surface of each of said fillets in contact with said roof substructure such that partial melting of said surface is effected to bond said surface to said roof substructure.

19. A process according to claim 17, wherein said sealing sheets are formed of a synthetic resin material, and said step of securing said sealing sheets to said fillets includes solution welding.

20. A process according to claim 18, wherein said sealing sheets are formed of soft PVC, and wherein said fillets include a layer of synthetic resin on the top surfaces of said fillets.

21. A process according to claim 20, wherein said layer of synthetic resin is soft PVC.

22. A process according to claim 21, wherein said step of solution welding is carried out by applying a PVC solution between said PVC sealing sheets and said PVC layer on the top surfaces of said fillets.

23. A process according to claim 16, wherein said fillets are formed with one of a rectangular or a Z-shaped cross-section.

24. A process according to claim 16, wherein the adjoining edges of said plurality of heat-insulating panels are formed step-shaped, and said fillets have a Z-shaped cross-section interlocking with said step-shaped edges.

* * * * *